United States Patent [19]

Iannarone

[11] 4,241,472

[45] Dec. 30, 1980

[54] CARRYING HANDLE FOR A SEWING MACHINE

[75] Inventor: Ronald C. Iannarone, Hillside, N.J.

[73] Assignee: The Singer Company, Stamford, Conn.

[21] Appl. No.: 66,970

[22] Filed: Aug. 16, 1979

[51] Int. Cl.[3] ..... B25G 3/00

[52] U.S. Cl. ..... 16/115; 112/258; 190/58 A

[58] Field of Search ..... 16/115, 125, 124, 114 R; 85/5 M; 190/58 A, 58 B, 58 R, 39; 224/45 R, 45 P, 45 F; 403/353, 316; 294/27 H; 312/244; 112/258, 259

[56] References Cited

U.S. PATENT DOCUMENTS

| | | | |
|---|---|---|---|
| 2,240,643 | 5/1941 | Finkle | 85/5 M |
| 2,398,644 | 4/1946 | Johnson | 85/5 M |
| 2,420,826 | 5/1947 | Irrgang | 16/2 UX |
| 3,285,637 | 11/1966 | Taussig | 16/125 X |
| 3,572,870 | 3/1971 | Marks et al. | 16/115 X |
| 3,751,130 | 8/1973 | Fresard | 312/244 |
| 4,044,701 | 8/1977 | Giesselmann | 112/259 |

FOREIGN PATENT DOCUMENTS

| | | | |
|---|---|---|---|
| 1946855 | 4/1970 | Fed. Rep. of Germany | 16/114 R |

*Primary Examiner*—Andrew V. Kundrat

*Attorney, Agent, or Firm*—William V. Ebs; Edward L. Bell; Robert E. Smith

[57] ABSTRACT

A sewing machine handle is provided with depending legs which terminate in eccentric pads that are insertable in holes in the casing of the machine at the top of the bracket arm and are caused to engage the inside of the casing and support the machine when the handle is lifted.

5 Claims, 3 Drawing Figures

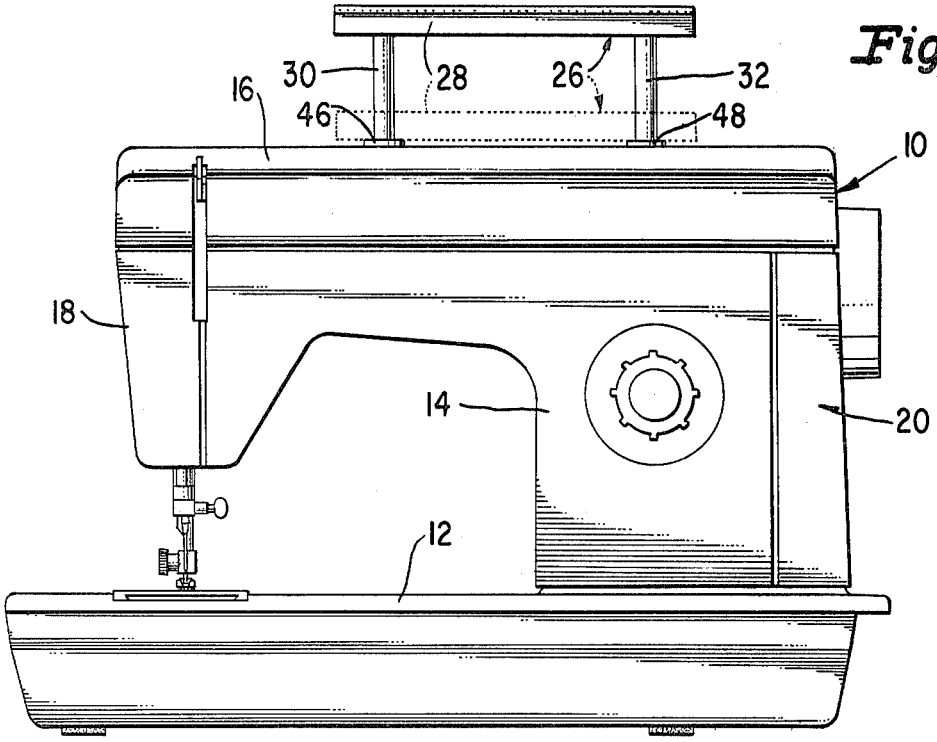
Fig. 1.
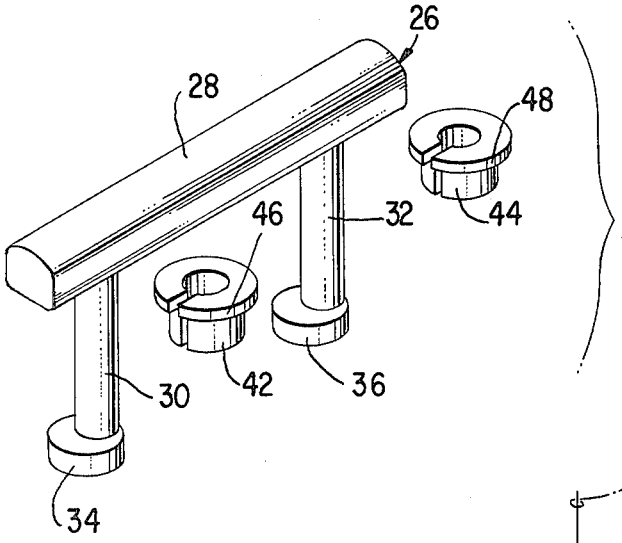
Fig. 2.
Fig.3.
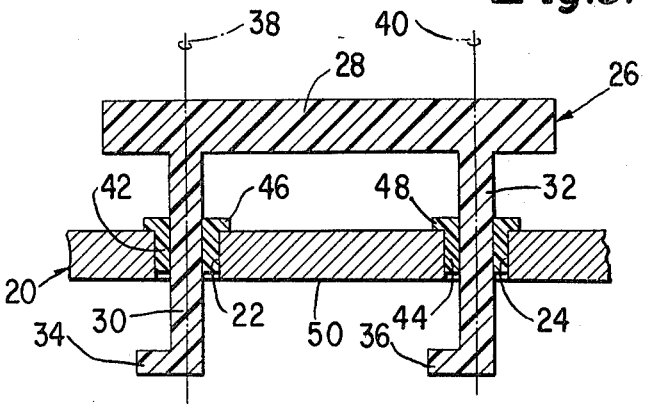

CARRYING HANDLE FOR A SEWING MACHINE

BACKGROUND OF THE INVENTION

1. Field of the Invention

The invention relates to sewing machine handles and more particularly to an arrangement for attaching a carrying handle to the casing of a sewing machine.

2. Description of the Prior Art

Carrying handles have been attached to portable sewing machines and carrying cases therefor in various ways. It is known, for example, as disclosed in Japanese Pat. No. 711,983 of Feb. 13, 1963, to secure a detachable handle to a machine with pivoted detent arms which are caused to engage recesses in studs secured to the structure of the machine. It is also known to lock a handle to a carrying case with spring biased lip members as in the manner described and illustrated in U.S. Pat. No. 3,910,329. Further, it is common practice to pivotally mount a carrying handle on the top of a portable machine so it can be folded down onto or into the machine when not in use.

However, prior arrangements, providing for the attachment of a carrying handle to a portable sewing machine or machine case, have generally proved to be unsatisfactory either because the required parts were costly to produce or the handle could not be collapsed to a stowed position when not needed to move the machine about.

It is a prime object of the present invention to provide a portable sewing machine with an improved handle attaching arrangement requiring only a few easily produced inexpensive parts and yet enabling the handle to be readily moved between a carrying position and a collapsed position in the machine housing.

SUMMARY OF THE INVENTION

In accordance with the invention, a carrying handle for a portable sewing machine is provided with depending legs which terminate in eccentric pads. The casing of the machine is provided with top openings to accommodate the pads and thereby permit the legs including the pads to be inserted therethrough. A split bushing snapped around each of the depending legs and tightly fitted in the opening for the leg in the casing disposes the legs in positions causing the terminal pads on the legs to engage the inside of the casing and support the machine when the handle is lifted to a carrying position. The handle may be easily depressed into an out-of-the-way position onto the top of the machine when not needed. The handle including the depending legs and eccentric pads is preferably formed as a one-piece molded plastic part, and each of the split bushing is preferably a molded plastic member.

DESCRIPTION OF THE DRAWINGS

FIG. 1 is a front elevational view of a sewing machine including the handle attaching arrangement of the invention;

FIG. 2 is an enlarged elevational perspective view showing associated handle attaching parts according to the invention; and FIG. 3 is a vertical sectional view taken through the handle of the invention and a portion of the casing of a sewing machine to which the handle is shown attached.

DESCRIPTION OF THE PREFERRED EMBODIMENT

Referring to the drawings, reference character 10 designates a portable sewing machine including a bed 12, standard 14, bracket arm 16 and head end portion 18 outlined by the casing 20 of the machine. The casing is provided with like circular openings 22 and 24 at the top of the racket arm 16 for a handle 26 which attaches thereto in a manner which will now be described.

As shown, handle 26 includes a hand grip 28 and cylindrical depending legs 30 and 32 which extend substantially perpendicularly to the hand grip. Leg 30 terminates in a circular perpendicularly extending eccentric pad 34, and leg 32 terminates in a like circular perpendicularly extending eccentric pad 36. As shown the pads 34 and 36 extend in the same direction from the legs 30 and 32 respectively. Longitudinal axes 38 and 40 of the legs 30 and 32 respectively, are separated by a distance equal to the distance between the centers of openings 32 and 24 in the casing 20. The circular pads 34 and 36 extend beyond the legs 30 and 32 respectively, a maximum distance which as measured from the longitudinal axes of the legs is greater than the radius of each of openings 22 and 24 in the casing, however, the diameter of each of the circular pads is slightly less than the diameter of the openings and they may therefor be introduced into the casing through openings 22 and 24.

Handle 26 is attached to the machine 10 with the aid of cylindrical split bushings 42 and 44 after eccentric pads 34 and 36 have been inserted into the casing 20 through the openings 22 and 24 respectively, at the top of bracket arm 16. Such bushings 42 and 44 are formed of resilient material and are snapped over the legs 30 and 32, after which the bushing 42 is pushed into opening 22 and the bushing 44 is pushed into opening 24. Pressure is applied to the bushings until they are tightly in place with outer cylindrical surfaces thereof in engagement with the casing in the openings and cannot be readily dislodged therefrom. As shown, the bushings are formed with flanges 46 and 48 and these seat against the outer surface of the casing of the bracket arm as the bushings assume tight fitting positions in the openings in the casing. The bushings align the longitudinal axes 38 and 40 of the legs with the center lines of openings 22 and 24 respectively, and therefore shift pad 34 off center with respect to opening 22 and the pad 36 off center with respect to opening 24.

The depending legs 30 and 32 of the handle are slidable on inside cylindrical surfaces in the bushings and the handle can therefore be readily raised and lowered with the hand grip 28. Because of the offset positions of the eccentric pads with respect to the openings in the casing at the top of the bracket arm, the pads move into positions of engagement with the inside surface 50 the casing as the handle is raised to a carrying position. When the machine is lifted by the handle, the pads are caused to bear against the casing and support the weight of the machine. The handle, in a lowered out-of-the-way position, rests on its underside against the flanges 46 and 48 of bushings 42 and 44.

The described handle attaching arrangement doesn't require adherence to tight dimensional tolerances during the manufacture thereof, and it is desirable in the interest of limiting production costs and simplifying manufacturing procedures to utilize molded plastic components. Handle 26 including the grip 28, legs 30 and 32, and the pads 34 and 36 may, of course, be fashioned from metal, but it is preferable for the reasons indicated to have it molded of plastic into the proper shape as a single piece not requiring machining. The bushings 42 and 44 are also preferably molded parts rather than machined metal pieces.

It is to be understood that the present disclosure relates to a preferred embodiment of the invention which is for purposes of illustration only, and that various modifications may be made therein without departing from the spirit and scope of the invention as defined in the appended claims. In particular, it is to be understood that although the depending legs of the sewing machine handle, the openings in the top of the casing, the split bushings and eccentric pads have been indicated as being cylindrical in form, that other configurations may also be employed, it being required, however, that the bushings so dispose the depending legs as to cause the terminal pads on the legs to engage the sewing machine casing and support the machine when the handle is lifted.

I claim:

1. In combination, a handle with depending legs which terminate in eccentric pads, a sewing machine casing with top openings having the depending legs and pads extending therethrough, a split bushing about each depending leg tightly fitted in the holes in the casing and permitting the handle to be moved between a raised position for lifting the machine and a lowered out of the way position on the machine, said bushings disposing the legs laterally in said top openings in positions causing the pads to engage the casing in surface to surface contact and support the machine when the handle is lifted.

2. The combination of claim 1 wherein the depending legs are cylindrical and the bushings have inside cylindrical surfaces which are slidingly engaged by the legs.

3. The combination of claim 1 wherein the holes in the casing are circular and the bushings have outer cylindrical surfaces to engage the casing in said holes.

4. The combination of claim 1 wherein the handle includes a hand grip which is integral with the depending legs and with respect to which the legs are substantially perpendicular.

5. The combination of claim 4 wherein the terminal pads are integral with the depending legs.

* * * * *